United States Patent [19]

Porter et al.

[11] Patent Number: 4,930,701

[45] Date of Patent: Jun. 5, 1990

[54] CONFLUENT NOZZLE

[75] Inventors: Eshmal L. Porter, St. Louis County; Walter E. Wozniak; Gerald D. Garner, both of Florissant, all of Mo.

[73] Assignee: McDonnell Douglas Corporation, Long Beach, Calif.

[21] Appl. No.: 294,950

[22] Filed: Jan. 3, 1989

Related U.S. Application Data

[63] Continuation of Ser. No. 94,240, Sep. 8, 1987, abandoned.

[51] Int. Cl.[5] ..... B05B 3/14

[52] U.S. Cl. ..... 239/102.2; 239/590

[58] Field of Search ..... 239/102.1, 102.2, 550, 239/587, 590.3, 589, 590.5

[56] References Cited

U.S. PATENT DOCUMENTS

| | | | |
|---|---|---|---|
| 1,840,863 | 1/1932 | Wenderhold | 239/590.3 |
| 2,453,595 | 11/1948 | Rosenthal | 239/102.2 X |
| 2,574,003 | 11/1951 | Wymer, Jr. | 239/590.3 X |
| 4,004,736 | 1/1977 | George | 239/102.2 |
| 4,034,025 | 7/1977 | Martner | 239/102.2 X |
| 4,251,031 | 2/1981 | Martin et al. | 239/102.2 |
| 4,393,991 | 7/1983 | Jeffras et al. | 239/102.2 |
| 4,646,967 | 3/1987 | Geithman | 239/4 |
| 4,647,013 | 3/1987 | Giachino | 239/102.2 X |
| 4,690,326 | 9/1987 | Gill | 239/397 X |

FOREIGN PATENT DOCUMENTS

| | | | |
|---|---|---|---|
| 144826 | 1/1962 | U.S.S.R. | 239/102.2 |

*Primary Examiner*—Andres Kashnikow

*Attorney, Agent, or Firm*—James M. Skorich; John P. Scholl; George W. Finch

[57] ABSTRACT

Nozzle contained within tubular housing. An annular manifold concentrically surrounds and abuts the outside of the housing. The manifold communicates with an external source of water. A cylindrical transducer is located within the housing. A hollow cone having an exit opening formed by a truncated vertex and an open base forms the front of the nozzle. The face of the transducer which emits ultrasonic waves is situated adjacent to the base of the cone. An annular passageway concentrically surrounds the transducer. The passageway runs axially towards the front of the nozzle before turning radially inward towards the nozzle's centerline. The axial section of the passageway communicates with the manifold through radial ports. The section of the passageway that turns inward communicates with the base of the cone, and also directs flow of water so that its confluence is on the emitting face of the transducer. The water subsequently flows out the exit opening in a steady state column.

4 Claims, 2 Drawing Sheets

CONFLUENT NOZZLE

This is a continuation of application Ser. No. 094,240, filed on Sept. 8, 1987, now abandoned.

BACKGROUND OF THE INVENTION

1. Field of the Invention

The present invention relates to nozzles and, more particularly, to a nozzle which minimizes the roughness along the edges of the column of water emitted by the nozzle.

2. Description of the Prior Art

The use of ultrasound to nondestructively inspect composite laminate parts for porosity, delaminations, and defects in bonding, is well known. Testing with ultrasound requires that a coupling medium, typically water, be used to transmit the ultrasonic waves between the transducer and the test object. Early apparatus required the test object to be submerged in water, while more recent devices use a nozzle to produce a column of water that extends between the transducer and the test object, and lies colinear with the ultrasonic waves.

A problem inherent in the use of a column of water to couple a pulse echo transducer with a test object is noise. Noise occurs when roughness along the surface of the water column causes multiple reflections of ultrasonic waves back to the transducer, resulting in spurious signals that interfere with the signals reflected from the test object that are used to analyze the composite laminate of the test object.

The spurious reflections also cause the decay of the outgoing wave at a higher rate that would otherwise be the case. The resultant loss in signal strength further reduces the signal to noise ratio when ultrasound is used in the pulse echo mode, as well as in the through transmission mode.

To retain an acceptable signal to noise ratio with the nozzles of the prior art, the emitting transducer must be maintained at a distance close enough to the test object to ensure that the edges of the column remain smooth before the column impinges on the test surface. When the surface undulates, this constraint requires incessant in and out movement of the nozzle normal to the surface of the test object.

Noise is also caused when the water column impinges on the test object and creates droplets that fall back into the column and create turbulence. As the size and frequency of such water droplets is proportional to the roughness of the surface of the water column, the noise from this effect increases with the column's surface roughness.

Efforts have been undertaken to improve the signal to noise ratio of ultrasonic testing apparatus by reducing the surface roughness of the coupling water column. Although it has been found that surface roughness is proportional to the spiral component of the velocity vector of the fluid in the column, efforts to design a nozzle to minimize this vector have not met with success.

Furthermore, it has been found that devices which force the water to flow through axial orifices in attempting to minimize the spiral component of the water flow, typically trap an air bubble adjacent to transducer face from which the ultrasonic waves are emitted. The air bubble causes reflection of the emitted ultrasonic waves, resulting in a further degradation of the signal to noise ratio of the transducer.

SUMMARY OF THE PRESENT INVENTION

The present invention is a nozzle having an annular manifold to collect coupling fluid, that is, water, from an external source. An annular axial passageway is situated concentric to the manifold, and communicates with it through radial ports. Both the manifold and the axial passageway are concentrically situated about a cylindrical ultrasonic transducer. A hollow truncated cone having a exit opening and an open flanged base forms the front of the nozzle. The vertical face of the transducer which emits the ultrasonic waves is adjacent to the base of the cone. After traveling axially towards the front of the nozzle, the passageway angles radially inward and communicates with the base of the cone.

The radial passage of the fluid through the radial ports eliminates most of the water's spiral velocity component. Any remaining spiral velocity component is damped out by the fluid's passage through the axial section of the passageway. The angle in the passageway directs the water radially inward and against the face of the transducer, thereby displacing any air bubbles. Radial velocity components of the fluid cancel each other out by their confluent meeting on the face of the transducer. The water forms a column on leaving the cone through the exit opening.

The present invention obtains a smooth surface on the column of the coupling fluid by substantially reducing the fluid's spiral velocity component. The nozzle thereby allows a fluid column to extend much further than the nozzle of the prior art with a signal to noise ratio high enough to allow meaningful test data to be obtained. This allows the ultrasonic test apparatus employing the nozzle to scan the surface of a test object having undulations without requiring as much in and out movement of the nozzle normal to the surface, compared to a nozzle of the prior art that must be positioned at a much closer distance to the surface.

For example, the nozzle of the prior art had to be kept at a distance of from 2 to 3 inches from a test object in order to maintain an acceptable signal to noise ratio, whereas, given a cone having the same dimensions and the same input water pressure, the present invention was able to provide the same signal to noise ratio at a distance of approximately 16 inches. It may not be practical to keep a nozzle separated from the test object by a distance anywhere near the maximum amount allowable with the present invention where the column of water is horizontal with respect to the ground, because gravity will cause the column to droop a significant amount. However, the effect of gravity would not be limiting factor where the nozzle and test object are oriented so that the column of water is normal to the ground.

Moreover, regardless of the distance between the nozzle and the surface of the test object, the present invention improves the signal to noise ratio of the emitted ultrasonic test signal by virtue of reducing the surface roughness of the column of coupling fluid. Additionally, the present invention prevents the formation of any air bubbles on the face of the transducer that would otherwise degrade the signal to noise ratio.

OBJECTS OF THE INVENTION

It is an object of the invention to provide a nozzle which emits a column of fluid which retains a relatively smooth outer surface for a length substantially greater than the fluid columns generated by the nozzles of the prior art.

It is another object of the present invention to provide a nozzle which prevents air bubbles from remaining trapped against the surface of an enclosed ultrasonic transducer while coupling fluid is flowing through the nozzle.

It is a further object of the present invention to provide a nozzle which emits a column of coupling fluid for an enclosed ultrasonic transducer while inducing a minimum of noise, for any given distance between the transducer and a test object.

DETAILED DESCRIPTION OF A PREFERRED EMBODIMENT

Figure 1:
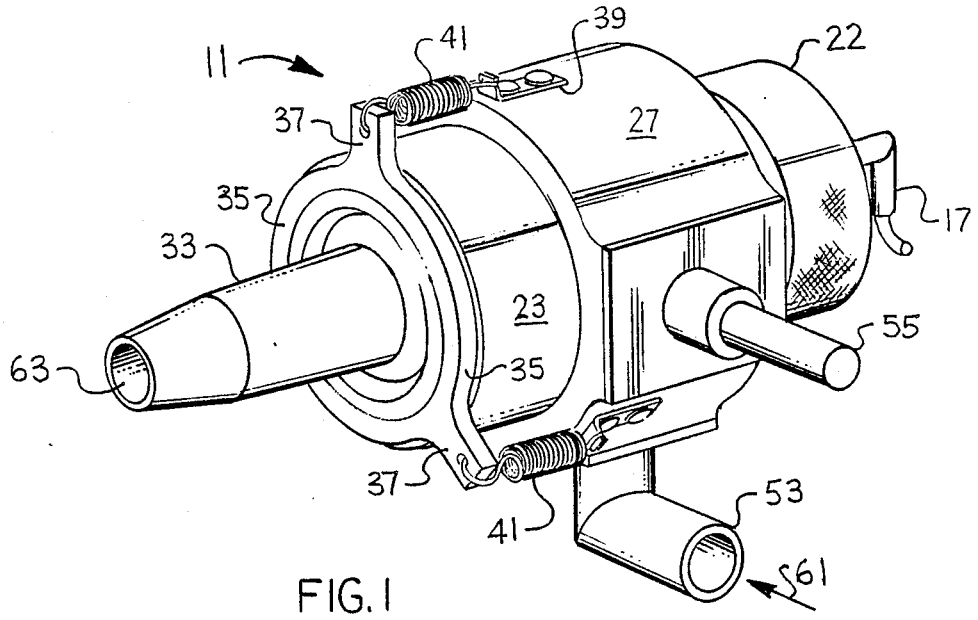
FIG. 1 is a perspective view of a preferred embodiment of the present invention.
Figure 2:
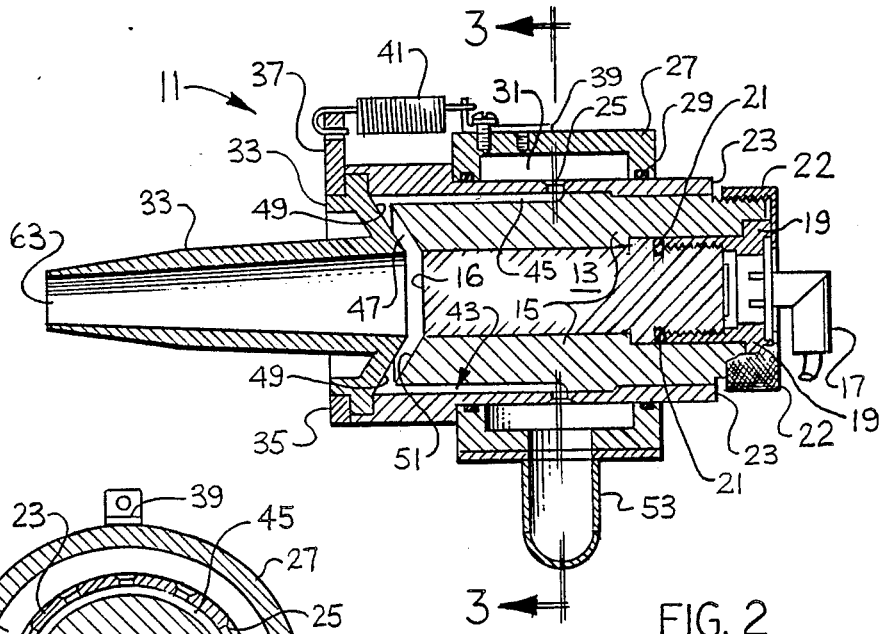
FIG. 2 is a longitudinal cross-section of the preferred embodiment of the present invention shown in FIG. 1.
Figure 3:
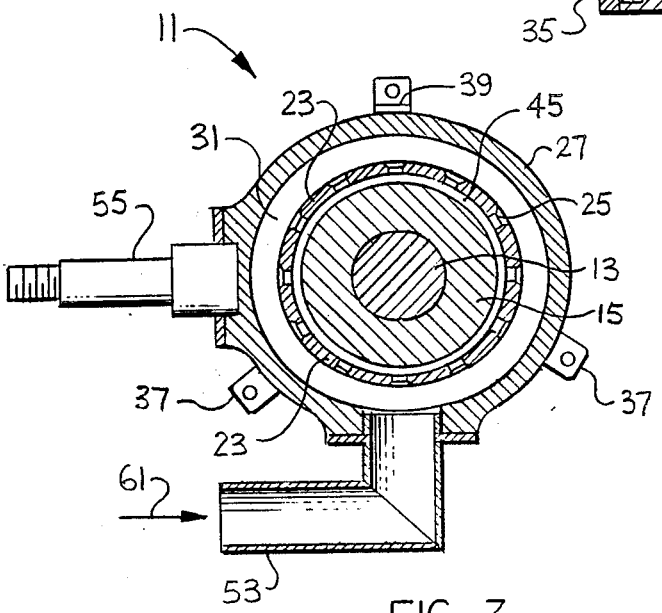
FIG. 3 is a sectional view taken along line 3—3 of FIG. 2.

FIGS. 1, 2 and 3 show several views of confluent nozzle 11, a preferred embodiment of the present invention. Cylindrical ultrasonic transducer 13 is located concentrically within annular sleeve 15. Ultrasonic waves generated by transducer 13 are emitted from face 16. Electrical connector 17 electrically connects transducer 13 to the other electrical and signal processing apparatus of a nondestructive testing device. Examples of such apparatus, as well as a detailed explanation of the techniques of through transmission and pulse echo ultrasonic testing and their theoretical underpinnings, are described in U.S. Pat. No. 4,685,966: "Ultrasonic Testing Apparatus" issued on Aug. 11, 1987 to Gerald D. Garner, et al.

Electrical connector 17 is bonded to interior sleeve 19. Interior sleeve 19 threadably engages the end of transducer 13 and keeps it properly positioned within annular sleeve 15. O-ring 21 is positioned in a groove in transducer 13. The engagement of interior sleeve 19 with transducer 13 also compresses O-ring 21 to form a water-tight seal. Cap 22 is threadably engaged with annular sleeve 15. Cap 22 abuts interior sleeve 19, and thereby keeps interior sleeve 19 and transducer 13 in proper position within annular sleeve 15.

Nozzle housing 23 surrounds sleeve 15. Ports 25 are radial holes in nozzle housing 23. Manifold 27 is an annular or toroidal housing that surrounds nozzle housing 23. O-rings 29 are seated in grooves along the edges of manifold 27 that lie adjacent to nozzle housing 23. Manifold chamber 31 is created by the abutment of manifold 27 and O-rings 29 with nozzle housing 23. O-rings 29 keep manifold chamber 31 water tight.

Hollow cone 33 abuts nozzle housing 23. Retainer 35 fits annularly around the flanged base of cone 33, and has three ears 37. Clips 39 are screwed onto manifold 27. One end of each of springs 41 is held by one of clips 39, and the other end is hooked through an opposing hole in one of ears 37. Springs 41 are held in tension, and press retainer 35 against cone 33, keeping cone 33 in abutment against nozzle housing 23.

In the event cone 33 accidentally strikes the test object while testing is being conducted, the aforementioned means of flexibly attaching cone 33 to nozzle housing 23 allows cone 33 to momentarily deflect and be returned to its normal position by springs 41. This design thus avoids damage to confluent nozzle 11 or having to interrupt testing for readjustment due to inadvertent impact.

Passageway 43 communicates between the hollow center of cone 33 and ports 25, and is comprised of axial section 45 and radial section 47. Axial section 45 and radial section 47 intersect at an angle of less than 90°. The centerline of radial section 47 intersects face 16 at an angle of less than 90°. Axial section 45 is comprised of the annular space between sleeve 15 and nozzle housing 23. Radial section 47 is formed by the space between aft face 49 of cone 33 and forward face 51 of sleeve 15. Water inlet 53 communicates between a source of water (not shown) and manifold chamber 31.

Figure 4:
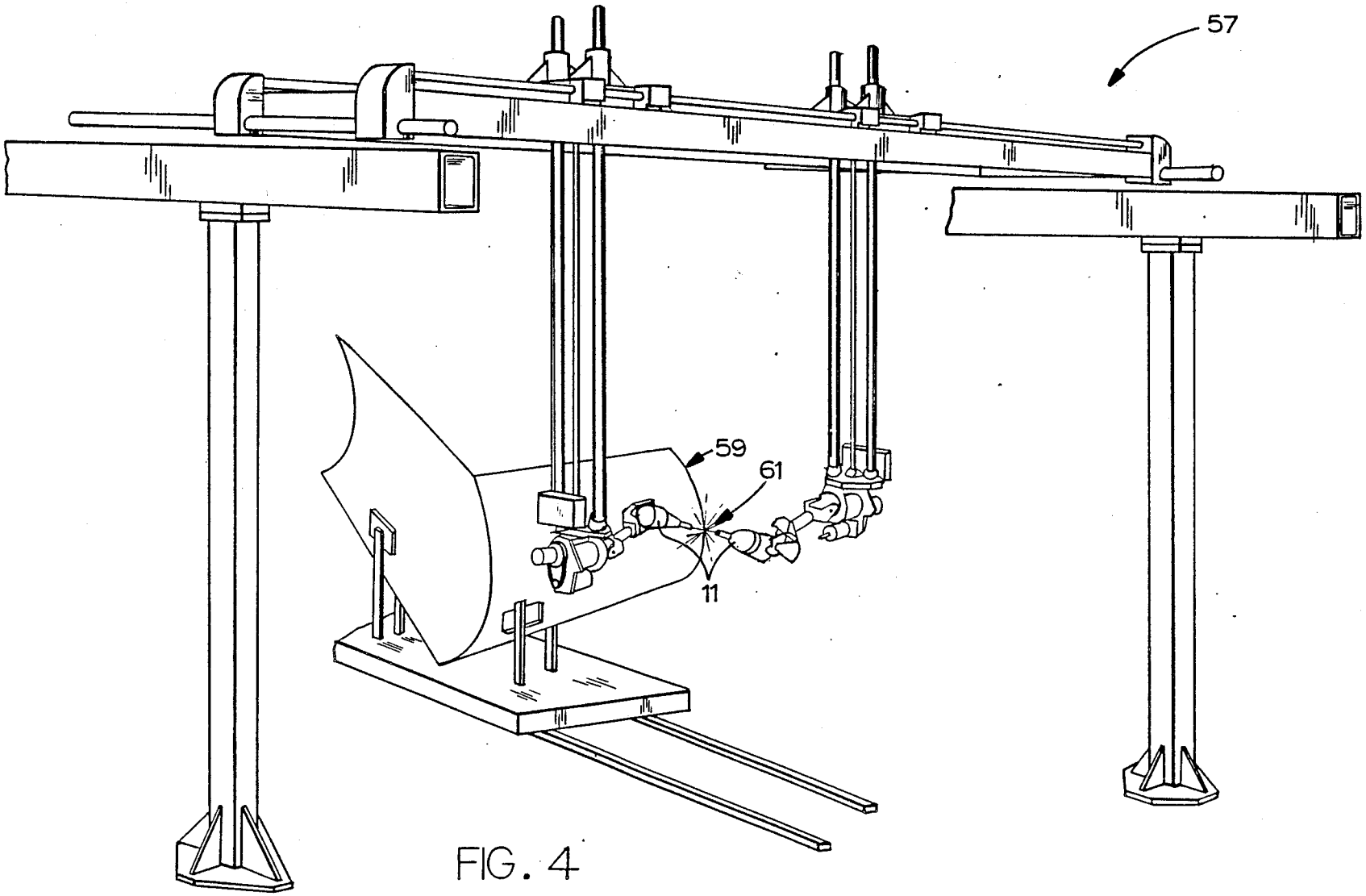
FIG. 4 shows the use of a preferred embodiment of the present invention as part of an ultrasonic testing apparatus.

As shown in FIG. 4, mounting spindle 55 provides for the rotatable mounting of confluent nozzle 11 on the linkage of ultrasonic testing apparatus 57. The foregoing drawing also shows object 59 being ultrasonically tested by apparatus 57.

In operation, water 61 enters manifold chamber 31 through water inlet 53. Water 61 then passes through ports 25 and into axial section 45 of passageway 43. As ports 25 are radial passageways, the movement of water 61 through ports 25 substantially reduces the spiral velocity component in the flow of water 61 that was present in manifold chamber 31, and also provides a uniform annular distribution of the incoming water.

As water 61 moves axially through axial section 45, the remaining spiral velocity component in the fluid is damped out. Water 61 is then deflected through an angle greater than 90° by aft face 49 into radial section 47, whereupon it is directed onto face 16 of transducer 13 at an angle of incidence less than 90°; and at its point of confluence.

The confluence of the flow of water 61 on face 16 cancels out any radial velocity component acquired in passing through radial section 47 of passageway 43, and also removes air bubbles from face 16. Water 61 then flows through cone 33 and forms a steady state column upon its exit through opening 63 of cone 33.

Changes and modifications in the specifically described embodiment can be carried out without departing from the scope of the invention, which is intended to be limited only by the scope of the appended claims.

What is claimed is:

1. A nozzle comprising:

an annular manifold;

a tubular casing that abuts the inner diameter of said manifold and is concentric with respect to said manifold;

an annular passageway that is concentric with said manifold and is located within said casing;

said annular passageway being comprised of an axial section which lies parallel to the centerline of said nozzle and a radial section which runs radially inward towards the centerline of said nozzle;

radial parts communicating said axial section communicating with said manifold;

a hollow cone having an opening formed from a truncated vertex and having an open base;

said radial section communicating with said base of said cone; and said annular passageway causing fluid flowing through said annular passageway to change direction by more than 90 degrees, and directing such fluid radially inward so that a confluence of fluid flow occurs within said nozzle.

2. A nozzle comprising:

a toroidal manifold circumventing a tubular casing;

an outlet;

an annular passageway having a straight axial section and a straight radial section, and fluidly communicating said manifold with said outlet;

said axial section intersecting said radial section at an angle no greater than ninety (90) degrees;

a face intersecting the centerline of said radial section at an angle of less than ninety (90) degrees;

said face being part of an ultrasonic transducer; and radial ports fluidly communicating said manifold with said axial section.

3. A nozzle comprising:

a toroidal manifold circumventing a tubular casing;

an outlet;

an annular passageway having a straight axial section and a straight radial section, and fluidly communicating said manifold with said outlet; and said axial section and said radial section intersecting at an angle of less than ninety (90) degrees.

4. A nozzle comprising:

a toroidal manifold circumventing a tubular casing;

a face;

means for fluidly communicating said manifold with said face, and for directing fluid flow to impinge upon said face;

said communication means including a passageway having an axial section and a radial section;

said axial section and said radial section intersecting at an angle of less than ninety (90) degrees;

a hollow cone having open ends; and said cone being in fluid communication with said face and having an axis of revolution lying normal to said face.

* * * * *